United States Patent [19]

Kamiya

[11] 4,103,525

[45] Aug. 1, 1978

[54] LEVER TUMBLER LOCK DEVICE HAVING VARIABLE WARD PATTERNS

[76] Inventor: Minoru Kamiya, 2-46-3, Minami-Otsuka, Toshima-ku, Tokyo, Japan

[21] Appl. No.: 803,532

[22] Filed: Jun. 6, 1977

[51] Int. Cl.[2] ..... E05B 19/18

[52] U.S. Cl. ..... 70/347; 70/398; 70/411

[58] Field of Search ..... 70/345, 346, 347, 375, 70/382, 383, 384, 393, 395, 398, 411, 420

[56] References Cited

U.S. PATENT DOCUMENTS

| | | | |
|---|---|---|---|
| 1,215,013 | 2/1917 | Fischer | 70/411 |
| 1,662,613 | 3/1928 | Laymor | 70/398 |
| 1,970,757 | 8/1934 | Lyons | 70/420 |
| 3,492,842 | 2/1970 | Schlage | 70/375 |

*Primary Examiner*—Robert L. Wolfe

*Attorney, Agent, or Firm*—Graybeal, Barnard & Uhlir

[57] ABSTRACT

A key and a lock in a lock device having variable bit and ward patterns, respectively. The key has two pieces of bit members, one member of which is slidably fitted in a groove defined in the other member, while the other is stationary. The lock has ward members cooperative to those of the key, one of the ward members being movable, and the other being stationary. Thus, when the key is inserted into the lock and turned to its angularly displaceable end, and the position of the movable bit member of the key is varied, then the cooperative movable ward member in the lock may be moved thereby accordingly. The both movable members are then rigidly fixed in desired position. Thus, the lock can no longer be opened by a duplicate key or a master key. Alternatively, the two bit and ward members in a key and a lock may be so designed as to be movable, respectively.

10 Claims, 11 Drawing Figures

LEVER TUMBLER LOCK DEVICE HAVING VARIABLE WARD PATTERNS

BACKGROUND OF THE INVENTION

1. Field of the Invention

This invention relates to a lock device, in which a key and a lock having variable bit and ward patterns, respectively, and more particularly to a lever tumbler lock device, in which one or both bit members of the key and one or both ward member of the lock, may be moved in cooperative relation and then fixed rigidly, respectively.

2. Description of the Prior Art

Locks which are available widely in the market may be classified into box locks, dial locks, time locks and combinations thereof.

The box locks may be further classified into a latch bolt type and a dead bolt type. In the dead bolt type lock, a bolt is moved by means of a key, in a manner that ward members provided within a lock may be moved by a specific key, when the key is turned, so that the lock may be opened or closed. This type of locks are referred to as lever tumbler locks and find a wide application.

The lever tumbler lock device, as has been described earlier, should be used in combination of a key and a lock. Thus, many attempts have been proposed to modify or improve the secrecy of a lock and a key. However, if a key is duplicated or stolen, then the secrecy of a lock is lost. On the other hand, there are often manufactured master keys according to the mass production of locks and keys. Thus, there is a risk that the secrecy of a lever tumbler lock is sometimes impaired.

SUMMARY OF THE INVENTION

It is accordingly an object of the present invention to provide a lock device, in which a key and a lock have variable bit and ward patterns, respectively, thereby keeping the secrecy of the lock.

It is another object of the present invention to provide a lock device, which disables the use of a duplicate key or a master key, because the bit patterns of a key and the ward patterns of a lock may be varied by the will of the user.

According to the present invention, there is provided a lock device, in which one of bit members of the key is slidingly fitted in the other bit member and may be rigidly fixed in a desired position by a fixing means, while one of ward members in the lock may be moved correspondingly and then rigidly fixed by another fixing means. To this end, one bit member of the key has a groove and the other bit member is slidingly fitted therein. The slidable bit member has a threaded stem, on which is engaged an internally threaded nut. A nut may be rigidly fixed on the stem by suitable means. Likewise, the lock has a movable ward member which may be moved and fixed by suitable means, commensurate with a varied bit pattern of the key. Thus, ward patterns of a lock and a key in the lock device may be varied by the will of the user, so that secrecy of the lock device may be kept in safe.

BRIEF DESCRIPTION OF THE DRAWINGS

FIGS. 1 through 3 are plan views of a lock according to the present invention, in which FIG. 2 is a cross-sectional view taken along the line I—I of FIG. 1

DESCRIPTION OF THE PREFERRED EMBODIMENTS

Figure 1:
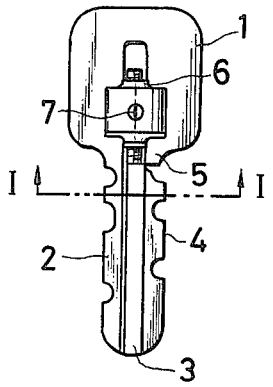
Figure 2:
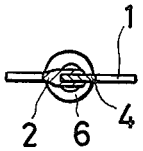

Referring to FIGS. 1 and 2, a key 1 includes a stationary ward member 2 having a predetermined bit pattern on one side. The bit member 2 includes groove 3 on a side opposite to the bit pattern, and a movable bit member 4 which is slidingly fitted in the groove 3 has a predetermined bit pattern. The movable bit member 4 has a threaded stem 5 integral therewith, on the free end of which is engaged a knurled nut 6. Accordingly, the stem 5 may be displaced due to the rotation of the nut 6, so that the movable bit member 4 slidingly moves relative to the stationary ward member 2. The nut 6 has a pin hole, in which is threaded a pin 7 for rigidly fixing the movable bit member 4 relative to a body 1 of the key.

For varying a ward pattern of the key, the pin 7 is drawn out of the nut 6, and then the nut 6 is rotated so as to slidingly move the stem 5. Thus, the movable bit member 4 is displaced accordingly. The stationary bit member 2 of the key is integral with the body 1 thereof. By changing the position of the movable bit member 4, there may be achieved a number of combinations of the bit patterns for the key. After the position of the movable bit member 4 is set or determined, the pin 7 is threaded into a hole in the nut 6 to fix the stem 5 rigidly. The nut 6 may be rigidly fixed by any other means, such as a rack type or spring type fixing means.

Figure 3:
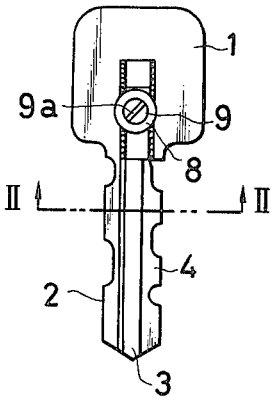

FIG. 3 shows another embodiment of a movable ward member of the key. As shown in FIG. 3, a bolt 9 is fitted into a through-hole provided in a root portion of a movable bit member 4, with a washer 8 placed under its head. The bolt 9 has a groove 9*a* in its head on the top thereof.

For moving the movable bit member 4, the tip of a screw driver is fitted in a slot 9*a* in the bolt 9, and turned, so as to loosen the bolt 9, so that the root portion of the movable bit member 4 may slide along the groove 3 so as to vary the position of the movable bit member 4. By threading the bolt 9 into a hole in the root portion, the movable bit member 4 may be rigidly fixed relative to the body of the key.

Figure 4:
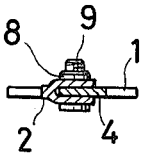
FIG. 4 is a cross-sectional view taken along the line II—II of FIG. 3.

FIG. 4 is a cross-sectional view of FIG. 3.

Figures 5A, 5B, 5C, 5D:
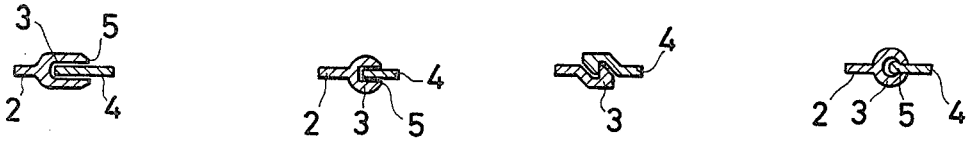
FIG. 5a-d is a front view of the key, having a movable bit member and a stationary bit member which are shown in an engaged condition.

FIG. 5 shows various embodiments of the stationary bit member 2 and movable bit member 4 in engagement with each other.

Figure 6:
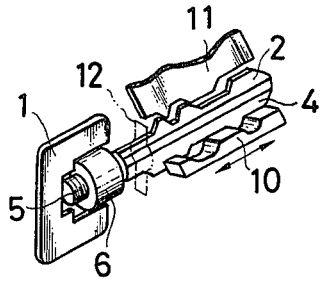
FIG. 6 is a perspective view of the key which is inserted into the lock.

FIG. 6 shows a perspective view of the key being inserted into the lock. The lock according to the present invention includes a stationary ward member 11 and a movable ward member 10 which cooperates with the movable bit member 4. Shown at 12 is a key hole.

Figure 7:
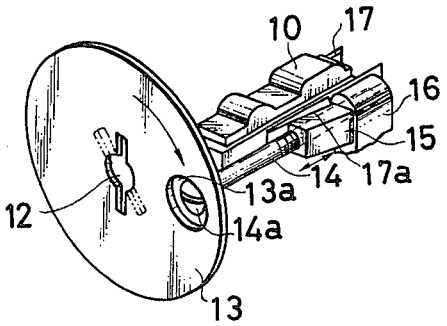
FIG. 7 is a perspective view illustrative of a mechanism for moving the ward member in the lock.

FIG. 7 is a perspective view of a mechanism for moving the movable ward member 10.

As is best shown in FIG. 7, the key is inserted into the key hole 12, and turned in the arrow direction, so that a face plate 13 is rotated in the same direction. As a result, a hole 13*a*, provided in the face plate 13, is brought into register with a head 14*a* of a ward-fixing stem 14.

The stem 14 is formed with a male thread 14*b* on the other end thereof, while a female thread 15*a* is provided in a taper nut 15 so as to mate with the male thread 14*b* on the stem 14. The taper nut 15 can not be rotated, but is movable in the axial direction. When the stem 14 is rotated, the taper nut 15 is displaced in the axial direction. One end of the stem 14 is fitted in a bearing 16. A slot type guide 17 is positioned parallel with the stem 14 on the side of the key hole 12 with respect to the stem 14. The movable ward member 10 is fitted in the slot type guide 17.

Figure 8:
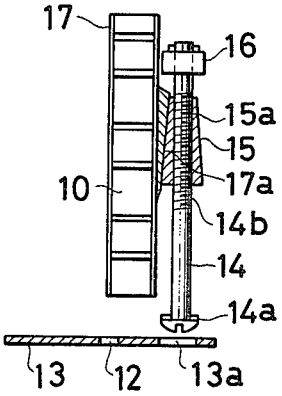
FIG. 8 is a plan view illustrative of a mechanism for moving the ward member in the lock.

FIG. 8 shows a plan view of a body of the lock according to the present invention. As best shown in FIG. 8, the head 14*a* of the stem 14 is turned by a screw driver in the clockwise direction, then the taper nut 14 is moved in the direction toward the face plate 13, so that a tapered surface of the taper nut 15 is detached from the tapered side-surface 17*a* of the slot type guide 17. As a result, the movable ward member 10 may be freely moved along the slot type guide 17. For fixing the movable ward member 10 rigidly, the head 14*a* is turned in the counterclockwise direction, then the taper nut 15 is drawn away from the face plate 13, so that the tapered surface of the taper nut 15 is brought into contact with the tapered surface of the side portion 17*a* of the slot type guide 17. As a result, the movable ward member 10 may be rigidly fixed by means of the side portion 17*a*. In this respect, the thickness of the side portion 17*a* is relatively reduced so as to provide elasticity, so that the side portion 17*a* may be resiliently urged in the direction of the ward member 10. However, the side portion 17*a* may be eliminated, so that the movable ward member 10 directly contact the taper nut 15. In this case, the movable ward member 10 may be rigidly fixed.

When the bit and ward patterns of the key and lock, respectively, are desired to be changed, the key 1 is inserted into the key hole 12, and turned to its lock-open position. In this case, the face plate 13 is rotated in the arrow direction so as to bring the head 14*a* of the stem 14 to appear through the hole 13*a*. The tip of a screw driver is then fitted in a slot in the head 14*a*, and then turned in the clockwise direction, so that the taper nut 15 may be disengaged from the slot type guide 17 and hence the movable ward member 10 may be freely displaced. Under such a condition, the pin 7 is drawn out of the key 1, and then the nut 6 is rotated so as to change the position of the movable bit member 4. In this respect, the movable ward member 10, maintained in engagement with the movable bit member 4, is also moved accordingly.

When the movable bit member 4 and movable ward member 10 are moved to desired positions, then the pin 7 is threaded into the nut 6, while the stem 14 is rotated in the counterclockwise direction so as to bring the taper nut 15 into engagement with the slot type guide 17 to rigidly fix the movable ward member 10.

Alternatively, the bit members 2 and 4, and ward members 10, 11 may so designed to be both moved, in cooperative relation. The direction of movable ward member or members is not limited to one side.

As is apparent from the foregoing description, the secrecy of the lock and key may be maintained in safe.

Although the present invention has been described with the respect to specific details of certain embodiments thereof, it is not intended that such details be limitations on the scope of the invention insofar as set forth in the following claims.

What is claimed is:

1. A lock device comprising:

a key having a stationary bit member integral with the body of said key, a movable bit member slidably engageable with said stationary bit member for lengthwise displacement of said movable bit member relative to said stationary bit member and key fixing means for rigidly maintaining said movable bit member in selected position in respect to said stationary bit member;

a lock having a stationary ward member corresponding to said stationary bit member, a movable ward member corresponding to said movable bit member, and lengthwise displaceable in respect to said stationary ward member, said movable ward member being lengthwise displaceable by and simultaneously with said movable bit member to form various ward patterns, and lock fixing means for rigidly fixing said movable ward member in respect to said stationary ward member; and whereby after said key is inserted in a keyhole in said lock and turned to the lock-open position, then said movable bit member is lengthwise displaceable to a desired position relative to said fixed bit member, thereby resulting in said movable ward member being cooperatively displaced in response to the movement of said movable bit member.

2. A lock device according to claim 1, wherein said stationary bit member includes multiple bittings and said movable bit member includes multiple bittings located in opposed parallel relationship with said stationary bit member bittings to enable the formation of selective bitting patterns when said movable bit member is lengthwise displaced in respect to said stationary bit member.

3. A lock device according to claim 2, wherein (a) said movable ward member includes an integral threaded stem extending lengthwise toward the body of said key;

(b) said key fixing means includes a nut engageable with said stem for altering the position of said movable bit member relative to said stationary bit member and includes means for maintaining said nut fixed in respect to said stem; and (c) the body of said key includes a slot closely encircling said nut for restraining lengthwise movement of said nut relative to the body of said key.

4. A lock device according to claim 1, wherein said lock further includes a face plate having a keyhole and a hole, said face plate being rotatable by said key such that when said key is turned to the lock-open position, said hole is in registration with a portion of said lock fixing means for enabling access to said second fixing means.

5. A lock device according to claim 4, wherein said lock fixing means includes guide means for slidably receiving said movable bit member for endwise movement of said movable bit member, and releasable means for maintaining said movable bit means stationary within said guide means.

6. A lock device according to claim 5, wherein:

(a) said guide means includes a resilient wall, said resilient wall having a tapered surface on the side of said wall opposite said movable bit, and (b) said releasable means includes a rotatable stem positioned in lengthwise parallel relationship with said resilient wall, and a tapered nut carried by said stem for wedging against said tapered surface of said resilient wall to maintain said movable ward stationary within said guide means and for disengaging from said tapered surface of said resilient wall to allow displacement of said movable ward along the length of said guide means.

7. A method of altering the configuration of a lock device having a lock including movable and stationary ward portions and a key including movable and stationary bit portions, said method comprising: engaging the lock with the key, selectively and simultaneously altering the position of the movable bit in respect to the stationary bit and the position of the movable ward in respect to the stationary ward, and disengaging the key from the lock.

8. A method of altering the configuration of a lock device according to claim 7, wherein the step of engaging the key with the lock includes inserting the key within the lock and turning the key to the lock-open position.

9. A method of altering the configuration of a lock according to claim 7, wherein the step of simultaneously altering the position of the movable bit and movable ward includes disengaging the lock fixing means, disengaging the key fixing means, selectively lengthwise displacing the movable bit in respect to the stationary bit so that the movable ward is cooperatively displaced in respect to the stationary bit a corresponding distance, i.e. engaging the key fixing means, and re-engaging the lock fixing means.

10. The method of altering the configuration of a lock according to claim 7, wherein the step of disengaging the key from the lock includes rotating the key to the lock-closed position and removing the key from the lock.

* * * * *